US005564974A

United States Patent [19]

Mazur et al.

[11] Patent Number: 5,564,974

[45] Date of Patent: Oct. 15, 1996

[54] COIN SORTING SYSTEM WITH TOUCH SCREEN DEVICE

[75] Inventors: Richard A. Mazur, Naperville; Gary P. Watts, Buffalo Grove; John E. Jones, Winnetka, all of Ill.

[73] Assignee: Cummins-Allison Corp., Mt. Prospect, Ill.

[21] Appl. No.: 301,343

[22] Filed: Sep. 6, 1994

[51] Int. Cl.[6] ..... G07D 3/16

[52] U.S. Cl. ..... 453/10; 453/32

[58] Field of Search ..... 453/2, 3, 4, 6, 453/10, 32, 31; 377/7

[56] References Cited

U.S. PATENT DOCUMENTS

| | | | |
|---|---|---|---|
| 4,682,288 | 7/1987 | Taipale et al. | 453/32 X |
| 4,782,328 | 11/1988 | Denlinger . | |
| 4,804,830 | 2/1989 | Miyagisima et al. | 235/379 |
| 4,806,709 | 2/1989 | Evans . | |
| 4,811,004 | 3/1989 | Person et al. . | |
| 4,851,616 | 7/1989 | Wales et al. . | |
| 4,928,094 | 5/1990 | Smith . | |
| 4,931,782 | 6/1990 | Jackson . | |
| 5,105,186 | 4/1992 | May . | |
| 5,141,443 | 8/1992 | Rasmussen et al. | 453/10 |
| 5,183,142 | 2/1993 | Latchinian et al. | 194/206 |
| 5,184,115 | 2/1993 | Black et al. . | |
| 5,198,976 | 3/1993 | Form et al. . | |
| 5,231,381 | 7/1993 | Duwaer . | |
| 5,297,030 | 3/1994 | Vassigh et al. . | |
| 5,317,140 | 5/1994 | Dunthorn . | |

OTHER PUBLICATIONS

Operator's Manual for JetSort® High Speed Coin Sorter/Counter, JetSort® 3000 Series, available from Cummins–Allison Corp. of Mount Prospect, Illinois.

*Primary Examiner*—F. J. Bartuska

*Attorney, Agent, or Firm*—Arnold, White & Durkee

[57] ABSTRACT

A coin sorting system comprises a coin sorter for sorting a plurality of coins, an operator interface panel, and a control unit coupling the operator interface panel to the coin sorter. The coin sorter includes a coin-driving member having a resilient surface and a stationary coin-guiding member having a coin-guiding surface opposing the resilient surface of the coin-driving member. The coin-guiding surface is positioned generally parallel to the resilient surface. The resilient surface of the coin-driving member is constructed and arranged to move the coins along the coin-guiding surface of the coin-guiding member. The coin-guiding surface forms a plurality of exit stations for selectively allowing exiting of the coins based upon their respective diameters. The operator interface panel includes a display unit and a touch screen mounted over the display unit. The display unit includes a plurality of display fields for displaying keys, coin sorter status, and sorted coin total. The touch screen forms a plurality of switches positioned over respective ones of the displayed keys, and the control unit operably couples the switches to their respective displayed keys. The displayed keys include key legends indicating sorted coin information provided by the displayed keys. Actuating the switches causes the control unit to generate on the display unit the sorted coin information provided by the displayed keys associated with the respective switches.

20 Claims, 11 Drawing Sheets

Fig. 7a

SETUP MAIN MENU

* ENABLE KEYS
* ENABLE FUNCTIONS
* DATA ENTRY SELECTIONS
* PORT SETUP
* PERIPHERAL FORMATS

HELP
MORE

Fig. 7B

SETUP MAIN MENU

* USER DEFAULTS
* BOX / BAG CONFIGURATIONS
* REPOSITION KEYS
* KEY LEDGENDS
* SCREEN COMPLEXITY

HELP
BACK

Fig. 8a

SELECT DIAGNOSTIC TEST:

* MEMORY INFORMATION
* ENCODER & COIN SENSORS
* KEYBOARD
* MOTOR
* COIN THRUPUT

HELP
MORE

Fig. 8b

SELECT DIAGNOSTIC TEST:

* COIN STOP
* BRAKE CYCLE
* COMM PORTS
* REMOTE DISPLAY
* MACHINE STATISTICS

HELP
BACK

Fig. 17a
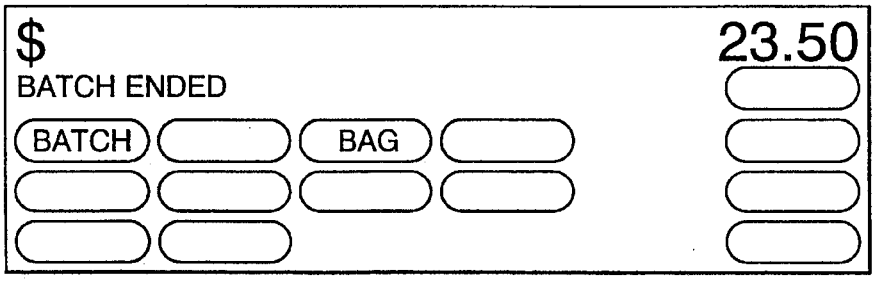
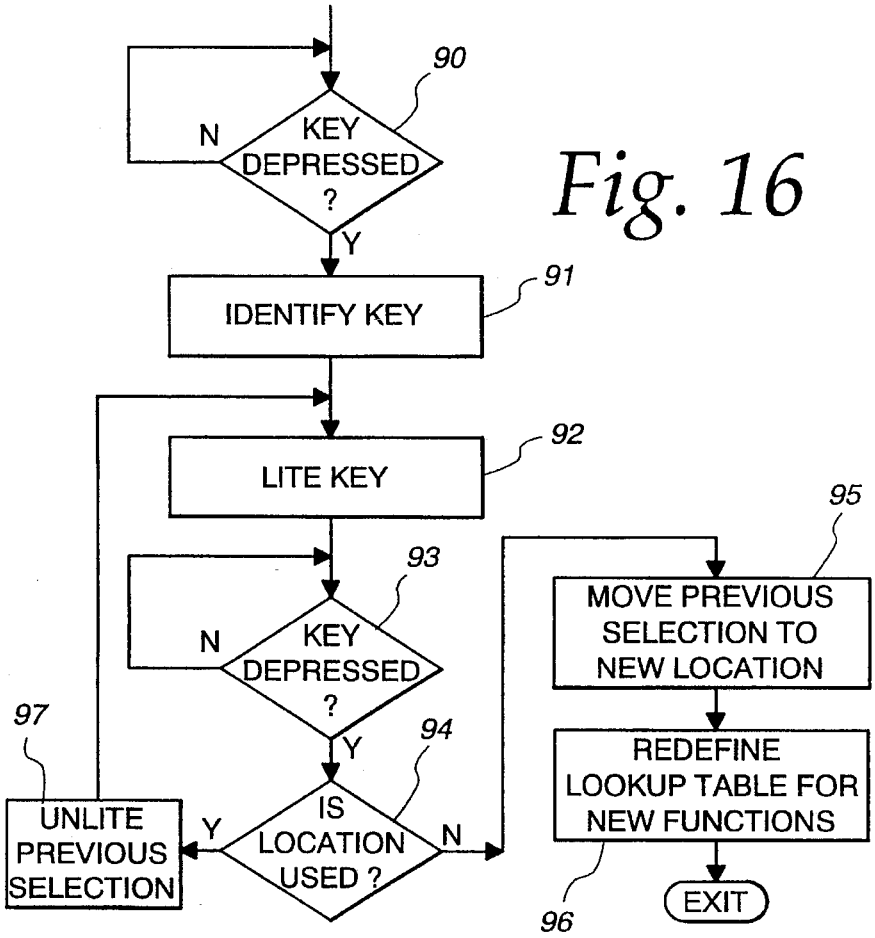
Fig. 16
Fig. 17b
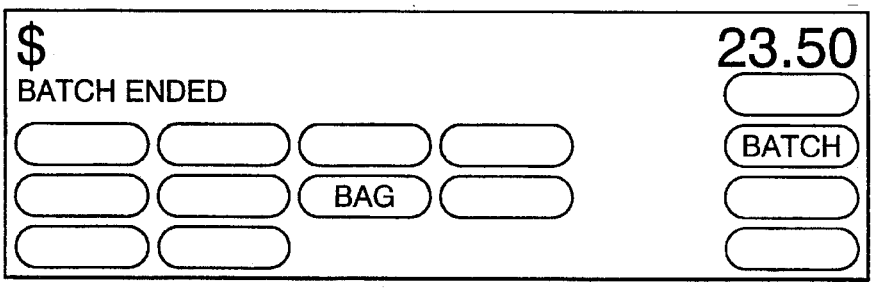

COIN SORTING SYSTEM WITH TOUCH SCREEN DEVICE

FIELD OF THE INVENTION

The present invention relates generally to coin sorting systems for sorting coins of mixed denominations. More particularly, the present invention relates to a coin sorting system having a coin sorter of the type which uses a coin-driving member having a resilient surface for moving coins along a coin-guiding surface of a stationary coin-guiding member. The coin sorting system employs a touch screen device to retrieve information concerning the coins processed through the coin sorter.

BACKGROUND OF THE INVENTION

In a coin sorting system of the foregoing type, a conventional mechanical keyboard with depressible keys is used to operate the coin sorter. For example, a START BATCH key is pressed to initiate movement of the coin-driving member. Coins from a batch of coins are then fed into the activated coin sorter for sorting. After the coin sorter sorts the coins, a STOP key may be pressed to temporarily stop movement of the coin-driving member. If additional unsorted coins remain in the batch, a CONTINUE key is pressed to re-activate the sorter and permit sorting of these additional coins. After the entire batch of coins has been sorted, an END key is pressed following depression of the STOP key to indicate the end of the batch of coins.

During the above operations, a display monitor adjacent the mechanical keyboard displays the status of the coin sorter. FIGS. 1*a–c* are diagrammatic representations of the prior art display monitor showing exemplary statuses of the coin sorter. For example, in response to pressing the START BATCH key, the display monitor displays "sort batch" to indicate that the coin sorter is activated and is sorting a batch of coins (FIG. 1*a*). As the coin sorter sorts the batch of coins, the display monitor displays the accumulated monetary value of the sorted coins. Furthermore, in response to pressing the STOP key and prior to pressing the END key, the display monitor displays "batch waiting" to indicate that the coin sorter is waiting for additional coins in the batch to be sorted or for the batch to be ended (FIG. 1*b*). Finally, in response to pressing the END key, the display monitor displays "batch ended" to indicate that the batch has been ended (FIG. 1*c*).

In addition to controlling the operation of the coin sorter, the conventional mechanical keyboard may be employed for information retrieval purposes. FIGS. 2*a*–d are diagrammatic representations of the display monitor showing different types of information which can be retrieved via the keyboard for display on the display monitor. More specifically, a MODE/COIN key is pressed to move a display cursor to line 2 of the display monitor (FIG. 2*a*). Next, arrow keys (e.g., <and >) are used to move the display cursor to a desired mode. The number on the upper right side of the display in FIG. 2*b* is the coin value for the mode selected with the cursor. For illustrative purposes, the selectable modes include BAT, S/B, BAG, and DAY. In the BAT mode, the number on the upper right side of the display denotes the total coin value of the current batch. In the S/B mode, the number on the upper side of the display denotes the total coin value for the current sub-batch. In the BAG mode, the displayed number denotes the total coin value in all bags capturing the sorted coins. In the DAY mode, the displayed number denotes the total value of all coins run since the last time DAY totals were cleared. While the display cursor is in a particular mode, the MODE/COIN key is pressed again and the arrow keys are used to view the total coin value for each coin denomination (FIGS. 2*b* and 2*c*). Pressing the MODE/COIN key a third time indicates the current operating mode (FIG. 2*d*).

The coin sorter may be connected to a primer to generate a primed report for a sorted batch of coins. To designate the source of the sorted batch of coins, the printed report is provided with four data entry fields with respective labels A, B, C, and D. These labels are assigned numeric codes to indicate the source of a coin batch. The numeric codes are entered using numeric keys 0 through 9 on the mechanical keyboard. If, for example, the coin sorter is owned by a vending company which has drivers #1, #2, and #3 picking up coins from customers X, Y, and Z, fields A and B on a batch report may be numerically labelled to represent the particular driver (route) and customer associated with the coin batch. Field A, for instance, may be labelled with the numeric code 123-456-7890 and field B may be labelled with the numeric code 331245.

The operation of the coin sorter using the foregoing operator interface panel (mechanical keyboard and display monitor) is further described in the JetSort®3000 Series Operator's Manual available from Cummins-Allison Corp. of Mount Prospect, Ill.

From the perspective of an operator, the foregoing operator interface panel is relatively unfriendly to the operator. For example, the labels A, B, C, and D for the data entry fields must be decoded to ascertain their meaning. It would be preferable to allow the operator to label the data entry fields with meaningful terms, such as words from a spoken language such as English, in addition to or in place of the labels A, B, C, and D. Although the mechanical keyboard could be expanded to include keys covering the letters of an alphabet, such an expanded keyboard would occupy a large amount of space on the interface panel. Alternatively, the interface panel could be modified to allow selection of letters displayed on the display monitor using the arrow keys to move a display cursor. This, however, would be a time-consuming operation.

The operator interface panel also provides an operator with little flexibility because the operator cannot easily customize the mechanical keyboard or the display monitor to best suit the needs of the operator. For example, the operator cannot delete keys, reposition keys, change keytop legends, etc. An operator having no use for a particular coin denomination such as pennies cannot delete all mechanical keys and references to that coin denomination. Furthermore, the operator cannot modify the complexity of the operator interface panel to match the level of operator experience. The number of keys on the keyboard may be overwhelming to a novice but appropriate for an experienced operator.

From the perspective of a manufacturer, the foregoing operator interface panel is disadvantageous because modifications to the interface panel involve changing the hardware associated with the interface panel. Hardware modifications are relatively time-consuming and expensive. As a result, the manufacturer cannot easily correct design errors, make field updates, or produce coin sorting machines dedicated to special environments.

A need therefore exists for a coin sorting system having an operator interface panel capable of overcoming the above-noted shortcomings associated with the foregoing type of operator interface panel.

SUMMARY OF THE INVENTION

In one particular embodiment, the present invention provides a coin sorting system comprising (1) a coin sorter for sorting a plurality of coins, (2) an operator interface panel, and (3) a control unit coupling the operator interface panel to the coin sorter. The coin sorter includes a coin-driving member having a resilient surface and a stationary coin-guiding member having a coin-guiding surface opposing the resilient surface of the coin-driving member. The coin-guiding surface is positioned generally parallel to the resilient surface. The resilient surface of the coin-driving member is constructed and arranged to move the coins along the coin-guiding surface of the coin-guiding member. The coin-guiding surface forms a plurality of exit stations for selectively allowing exiting of the coins based upon their respective diameters.

The operator interface panel includes a display unit and a touch screen mounted over the display unit. The display unit includes a plurality of display fields for displaying keys, coin sorter status, and sorted coin total. The touch screen forms a plurality of switches positioned over respective ones of the displayed keys, and the control unit operably couples the switches to their respective displayed keys. The displayed keys include key legends indicating sorted coin information provided by the displayed keys. Actuating the switches causes the control unit to generate on the display unit the sorted coin information provided by the displayed keys associated with the respective switches.

BRIEF DESCRIPTION OF THE DRAWINGS

Other objects and advantages of the invention will become apparent upon reading the following detailed description and upon reference to the drawings in which:

FIGS. 7*a–b* are diagrammatic representations of the touch screen device in FIG. 6 showing a main setup menu while the controller in FIG. 5 is in a setup mode;

FIGS. 8*a–b* are diagrammatic representations of the touch screen device in FIG. 6 showing a main diagnostic test menu while the controller in FIG. 5 is in a diagnostic test mode;

FIG. 16 is a flow diagram showing the operation of repositioning a key displayed on the touch screen device in FIG. 6, using the setup mode of the controller in FIG. 5;

FIGS. 17*a–b* are diagrammatic representations of the touch screen device in FIG. 6 showing display patterns with a BATCH key and BAG key in two different positions;

Figure 1A:
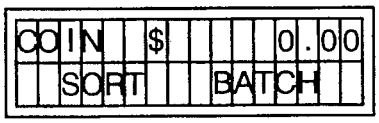
Prior Art Fig. 1a
FIGS. 1*a*–c are diagrammatic representations of a prior art display monitor used with a disc-type coin sorter and showing exemplary statuses of the coin sorter.
Figure 1B:
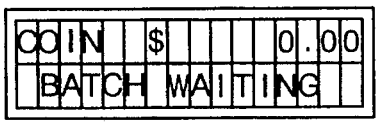
Prior Art Fig. 1b
Figure 1C:
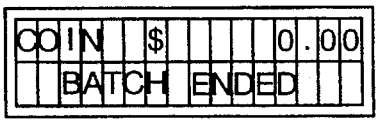
Prior Art Fig. 1c
Figure 2A:
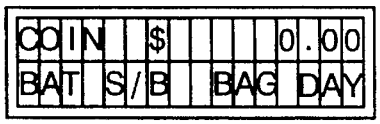
Prior Art Fig. 2a
FIGS. 2*a–d* are diagrammatic representations of the prior art display monitor in FIG. 1 showing different types of information which can be retrieved via a prior art mechanical keyboard for display on the display monitor.
Figure 2B:
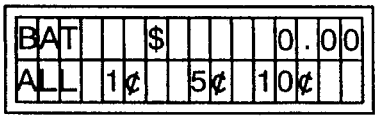
Prior Art Fig. 2b
Figure 2C:
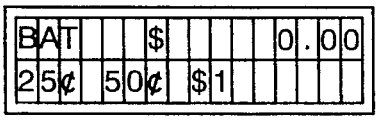
Prior Art Fig. 2c
Figure 2D:
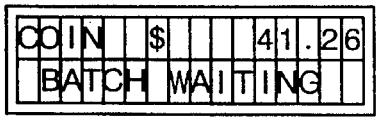
Prior Art Fig. 2d

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DESCRIPTION OF THE PREFERRED EMBODIMENT

Figure 3:
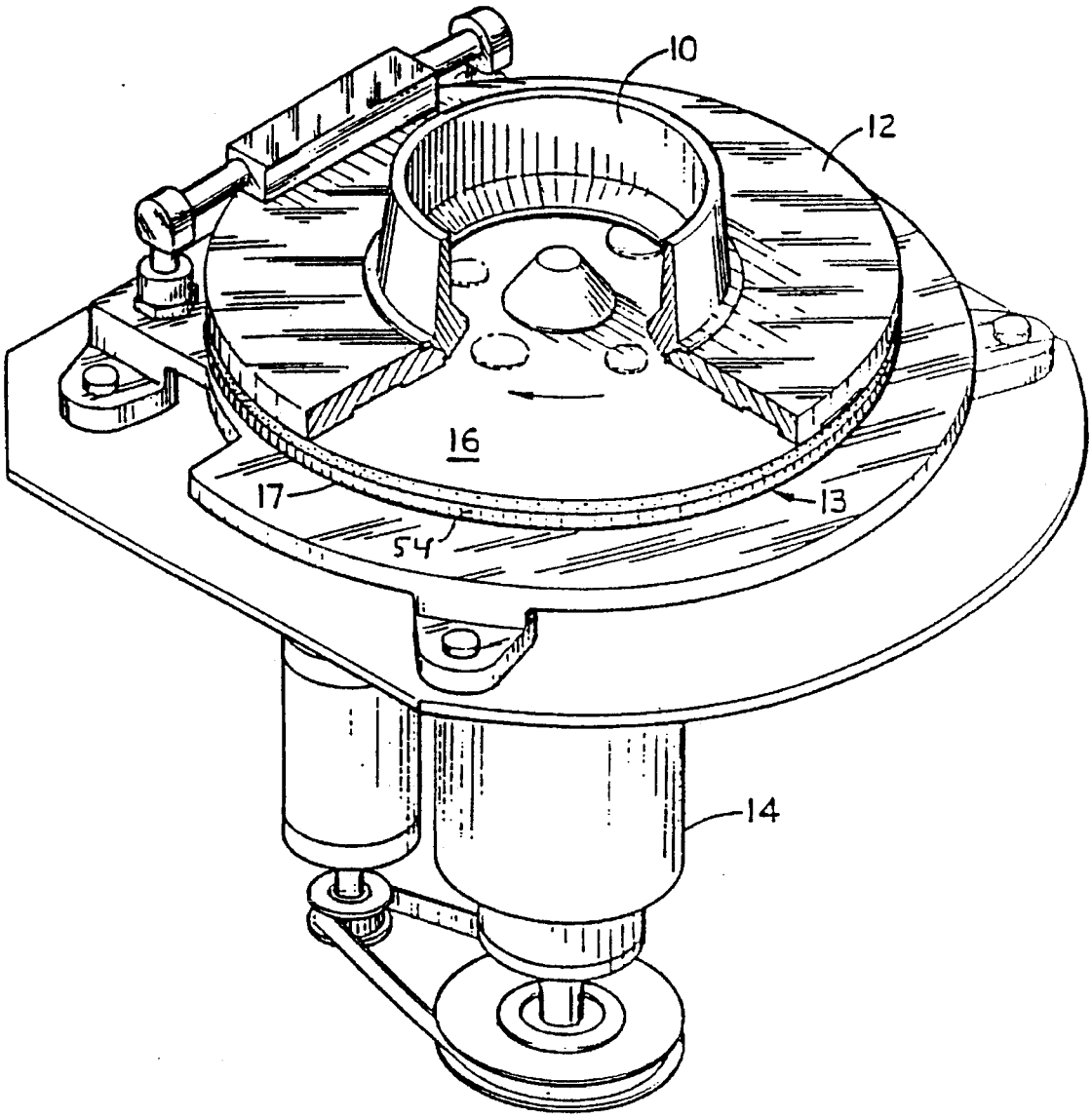
FIG. 3 is perspective view of a disc-type coin sorter with portions thereof broken away to show the internal structure.

Turning now to the drawings and referring first to FIG. 3, a hopper 10 receives coins of mixed denominations and feeds them through central openings in an annular sorting head or guide plate 12. As the coins pass through these openings, they are deposited on the top surface of a rotatable disc 13. This disc 13 is mounted for rotation on a stub shaft (not shown) and driven by an electric motor 14. The disc 13 comprises a resilient pad 16, preferably made of a resilient rubber or polymeric material, bonded to the top surface of a solid metal disc 17.

As the disc 13 is rotated, the coins deposited on the top surface thereof tend to slide outwardly over the surface of the pad due to centrifugal force. As the coins move outwardly, those coins which are lying flat on the pad enter the gap between the pad surface and the guide plate 12 because the underside of the inner periphery of this plate is spaced above the pad 16 by a distance which is about the same as the thickness of the thickest coin.

Figure 4:
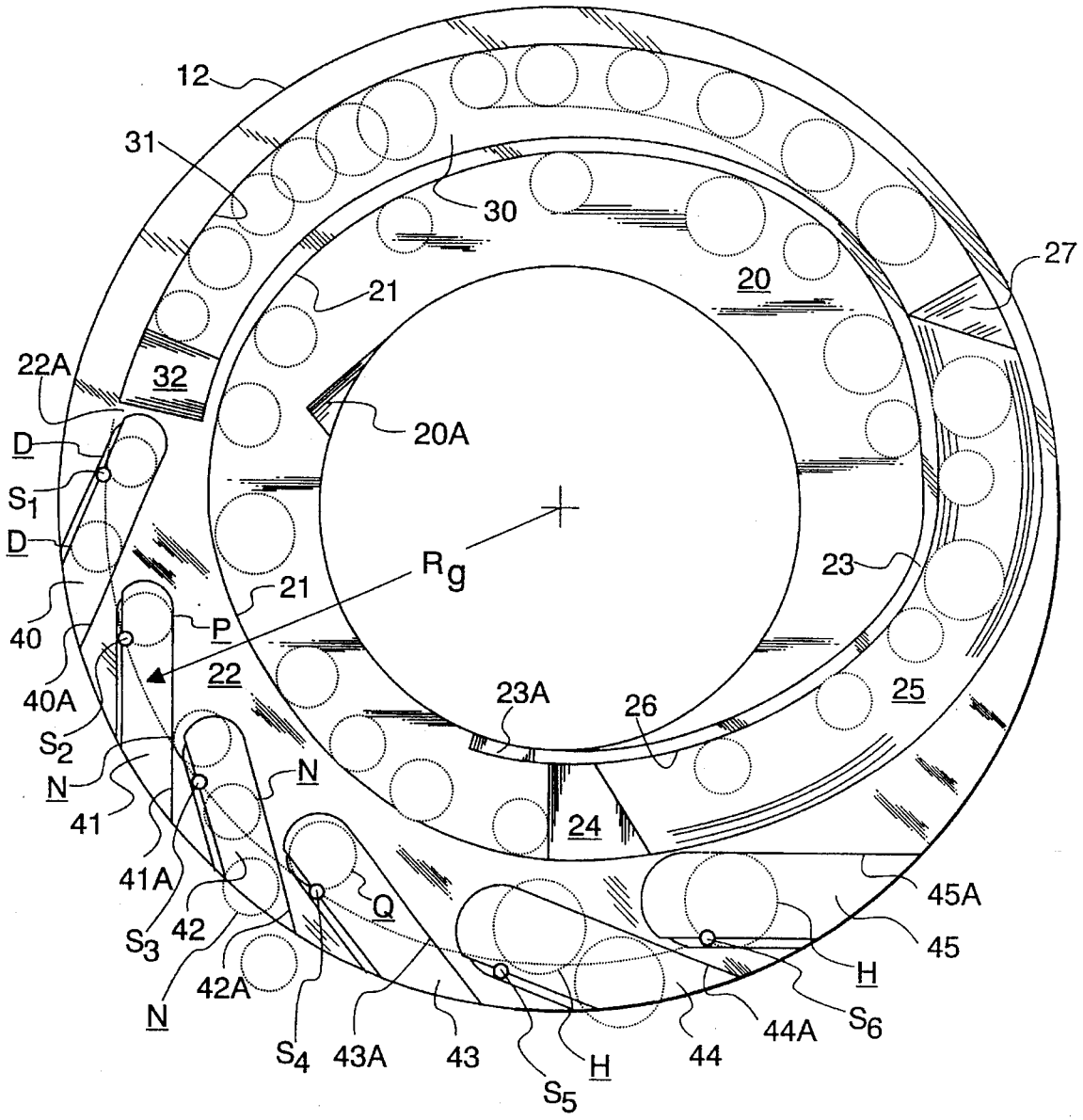
FIG. 4 is an enlarged bottom plan view of a sorting head or guide plate in the coin sorter of FIG. 3.

As can be seen most clearly in FIG. 4, the outwardly moving coins initially enter an annular recess 20 formed in the underside of the guide plate 12 and extending around a major portion of the inner periphery of the annular guide plate. The outer wall 21 of the recess 20 extends downwardly to the lowermost surface 22 of the guide plate Consequently, the initial radial movement of the coins is terminated when they engage the wall 21 of the recess 20, though the coins continue to move circumferentially along the wall 21 by the rotational movement of the pad 16. Overlapping coins which only partially enter the recess 20 are stripped apart by a notch 20*a* formed in the top surface of the recess 20 along its inner edge.

The only portion of the central opening of the guide plate 12 which does not open directly into the recess 20 is that sector of the periphery which is occupied by a land 23 whose lower surface is at the same elevation as the lowermost surface 22 of the grade plate. The upstream end of the land 23 forms a ramp 23*a*, which prevents certain coins stacked on top of each other from reaching the ramp 24. When two or more coins are stacked on top of each other, they may be pressed into the resilient pad 16 even within the deep peripheral recess 20. Consequently, stacked coins can be located at different radial positions within the channel 20 as they approach the land 23. When such a pair of stacked coins has only partially entered the recess 20, they engage the ramp 23*a* on the leading edge of the land 23. The ramp 23*a* presses the stacked coins downwardly into the resilient pad 16, which retards the lower coin while the upper coin continues to be advanced. Thus, the stacked coins are stripped apart so that they can be recycled and once again enter the recess 20, this time in a single layer.

When a stacked pair of coins has moved out into the recess 20 before reaching the land 23, the stacked coins engage the inner spiral wall 26. The vertical dimension of the wall 26 is slightly less than the thickness of the thinnest coin, so the lower coin in a stacked pair passes beneath the wall and is recycled while the upper coin in the stacked pair is cammed outwardly along the wall 26. Thus, the two coins are stripped apart with the upper coin moving along the guide wall 26, while the lower coin is recycled.

As coins within the recess 20 approach the land 23, those coins move outwardly around the land 23 and engage a ramp 24 leading into a recess 25 which is an outward extension of the inner peripheral recess 20. The recess 25 is preferably just slightly wider than the diameter of the coin denomination having the greatest diameter. The top surface of the major portion of the recess 25 is spaced away from the top of the pad 16 by a distance that is less than the thickness of the thinnest coin so that the coins are gripped between the guide plate 12 and the resilient pad 16 as they are rotated through the recess 25. Thus, coins which move into the recess 25 are all rotated into engagement with the outwardly spiralling inner wall 26, and then continue to move outwardly through the recess 25 with the inner edges of all the coins riding along the spiral wall 26. The primary purpose of the outward spiral formed by the wall 26 is to space apart the coins so that during normal steady-state operation of the sorter, successive coins will not be touching each other.

Rotation of the pad 16 continues to move the coins along the wall 26 until those coins engage a ramp 27 sloping downwardly from the recess 25 to a referencing recess of the guide plate 12. Because the surface of the referencing recess 30 is located closer to the pad 16 than the recess 25, the effect of the ramp 27 is to further depress the coins into the resilient pad 16 as the coins are advanced along the ramp by the rotating disc. As the coins emerge from the ramp 27, the coins enter the referencing recess 30 which presses all coin denominations firmly against the resilient pad 16. The outer edge of this recess 30 forms an inwardly spiralling wall 31 which engages and precisely positions the outer edges of the coins before the coins reach the exit channels which serve as means for discriminating among coins of different denominations according to their different diameters.

The inwardly spiralling wall 31 reduces the spacing between successive coins, but only to a minor extent so that successive coins remain spaced apart. The inward spiral closes any spaces between the wall 31 and the outer edges of the coins so that the outer edges of all the coins are eventually located at a common radial position, against the wall 31, regardless of where the outer edges of those coins were located when they initially entered the recess 30.

At the downstream end of the referencing recess 30, a ramp 32 slopes downwardly from the top surface of the referencing recess 30 to region 22*a* of the lowermost surface 22 of the guide plate. Thus, at the downstream end of the ramp 32 the coins are gripped between the guide plate 12 and the resilient pad 16 with the maximum compressive force. This ensures that the coins are held securely in the radial position initially determined by the wall 31 of the referencing recess 30.

Beyond the referencing recess 30, the guide plate 12 forms a series of exit channels 40, 41, 42, 43, 44 and 45 which function as selecting means to discharge coins of different denominations at different circumferential locations around the periphery of the guide plate. Thus, the channels 40–45 are spaced circumferentially around the outer periphery of the plate 12, with the innermost edges of successive pairs of channels located progressively farther away from the common radial location of the outer edges of all coins for receiving and ejecting coins in order of increasing diameter. In the particular embodiment illustrated, the six channels 40–45 are positioned and dimensioned to eject dimes (channel 40), pennies (channel 41), nickels (channel 42), quarters (channel 43), dollars (channel 44), and half dollars (channel 45). The innermost edges of the exit channels 40–45 are positioned so that the inner edge of a coin of only one particular denomination can enter each channel; the coins of all other denominations reaching a given exit channel extend inwardly beyond the innermost edge of that particular channel so that those coins cannot enter the channel and, therefore, continue on to the next exit channel.

For example, the first exit channel 40 is intended to discharge only dimes, and thus the innermost edge 40*a* of this channel is located at a radius that is spaced inwardly from the radius of the referencing wall 31 by a distance that is only slightly greater than the diameter of a dime. Consequently, only dimes can enter the channel 40. Because the outer edges of all denominations of coins are located at the same radial position when they leave the referencing recess 30, the inner edges of the pennies, nickels, quarters, dollars, and half dollars all extend inwardly beyond the innermost edge 40*a* of the channel 40, thereby preventing these coins from entering that particular channel. This is illustrated in FIG. 4 which shows a dime D captured in the channel 40, while pennies P, nickels N, quarters Q, dollars S, and half dollars H bypass the channel 40 because their inner edges extend inwardly beyond the innermost edge 40*a* of the channel so that they remain gripped between the guide plate surface 22*b* and the resilient pad 16.

Of the coins that reach channel 41, the inner edges of only the pennies are located close enough to the periphery of the guide plate 12 to enter this exit channel. The inner edges of the nickels, quarters, dollars, and half dollars extend inwardly beyond the innermost edge 41*a* of the channel 41 so that they remain gripped between the guide plate and the resilient pad. Consequently, the nickels, quarters, dollars, and half dollars are rotated past the channel 41 and continue on to the next exit channel. This is illustrated in FIG. 4 which shows pennies P captured in the channel 41, while nickels N, quarters Q, dollars S, and half dollars H bypass the channel 41 because the inner edges of these coins extend inwardly beyond the innermost edge 41*a* of the channel 41. Similarly, only nickels can enter the channel 42, only quarters can enter the channel 43, only dollars can enter the channel 44, and only half dollars can enter the channel 45.

As can be seen in FIG. 4, coin proximity sensors S1, S2, S3, S4, S5, and S6, are mounted in the upper surfaces of the respective exit channels 41–45 along the outboard edges thereof. The effective fields of the sensors $S_1$–$S_6$ are all located just outboard of the radius $R_g$ at which the outer edges of all coin denominations are gaged before they reach the exit channels 40–45, so that each sensor detects only the coins which enter its exit channel and does not detect the coins which bypass that exit channel. Thus, in FIG. 4 the circumferential path followed by the outer edges of all coins as they traverse the exit channels is illustrated by the dashed-line arc $R_g$. Only the largest coin denomination (e.g., U.S. half dollars) reaches the sixth exit channel 45, and thus the location of the sensor in this exit channel is not as critical as in the other exit channels 45–44. A counting system accumulates electrical pulses from the six sensors $S_1$–$S_6$ to yield actual counts $C_D$, $C_P$, $C_N$, $C_Q$, $C_S$, and $C_H$ of dimes, pennies, nickels, quarters, dollars, and half dollars passing through the respective exit channels 40, 41, 42, 43, 44, and 45.

Figure 5:
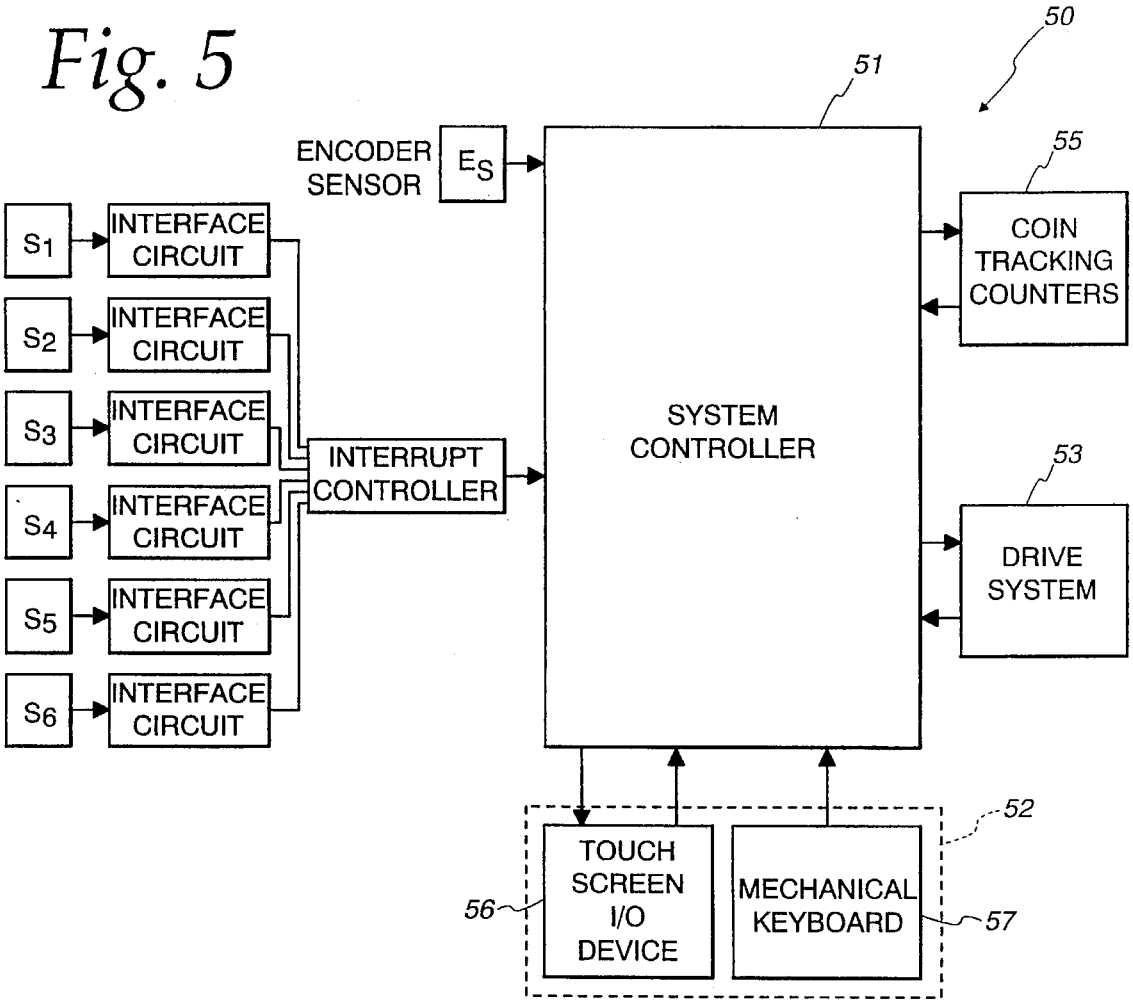
FIG. 5 is a block diagram of a processor-based control system for controlling the operation of the coin sorter in FIG. 3.

Referring now to FIG. 5, there is shown an upper level block diagram of a processor-based control system 50 for controlling the operation of the coin sorter in FIG. 3. The control system 50 includes a system controller 51 for monitoring and regulating the various parameters involved in the coin sorting/counting and bag-stopping operations. The controller 51 accepts signals from an operator interface panel 52, the six coin sensors $S_1$–$S_6$, an encoder sensor $E_S$, and six coin-tracking counters 55. The operator interface panel 52 includes a touch screen input/output device 56 and a conventional mechanical keyboard 57 with depressible keys. The controller 51 produces output signals to control the drive system 53, the six coin-tracking counters, and the touch screen device 56 of the operator interface panel 52.

To permit precise monitoring of the angular movement of the disc 13, the outer peripheral surface of the disc carries an encoder in the form of a large number of uniformly spaced indicia 54 (see FIG. 3) which can be sensed by the encoder sensor $E_S$ mounted adjacent the spaced indicia 54. In the particular example illustrated, the disc has 720 indicia 54 so that the sensor produces an output pulse for every 0.5° of movement of the disc 13. The pulses from the encoder sensor are supplied to six coin-tracking down counters for separately monitoring the movement of each of the six coin denominations in the exit channels 40–45 of the sorting head. The outputs of these six counters can then be used to separately control the actuation of the drive system 53, which includes a drive motor and a brake. For example, whenever one of the counts $C_D$, $C_P$, $C_N$, $C_Q$, $C_S$, and $C_H$ reaches its limit, the controller 51 generates a control signal to initiate a bag-stop function. For the bag-stop function, the control signal preferably stops the drive for the rotating disc and at the same time actuates the brake for the disc. The disc drive can be stopped either by de-energizing the drive motor or by actuating a clutch which de-couples the drive motor from the disc. The structure and operation of both the encoder 54, encoder sensor $E_S$, and the drive system 53 are described in further detail in U.S. Pat. No. 5,299,977 to Mazur et al. entitled "Coin Handling System" and incorporated herein by reference.

Figure 6:
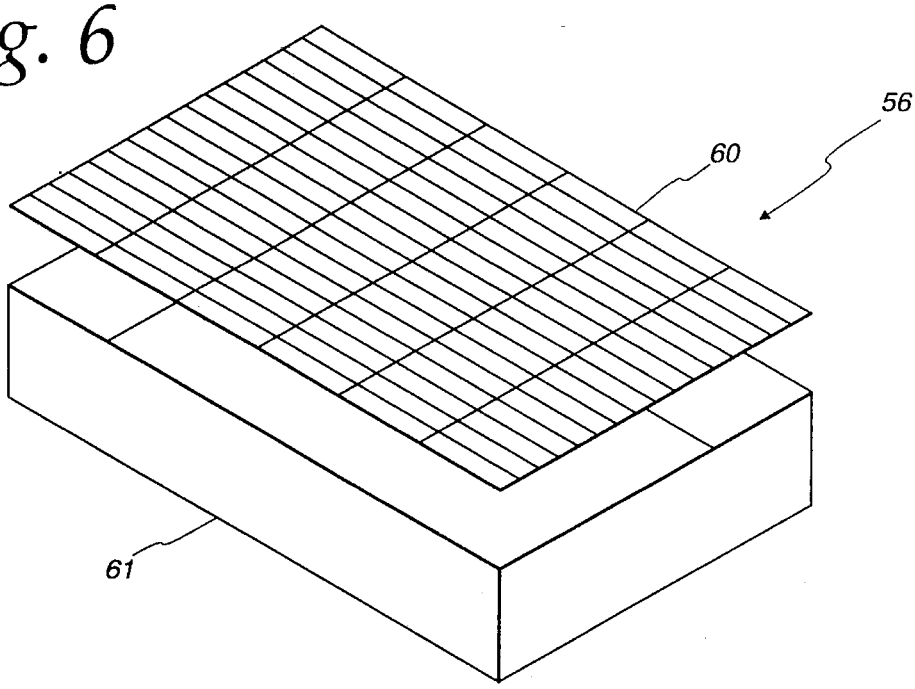
FIG. 6 is an exploded perspective view of a touch screen device of the control system in FIG. 5.

Referring now to FIG. 6, the touch screen I/O device 56 includes a touch screen 60 mounted over a graphics display 61. In the preferred embodiment, the display 61 is a liquid crystal display (LCD) with backlighting. The preferred display has 128 vertical pixels and 256 horizontal pixels. The display 61 contains a built-in character generator which permits the display 61 to display text and numbers having font and size predefined by the manufacturer of the display. Moreover, the controller 51 is programmed to permit the loading and display of custom fonts and shapes (e.g., key outlines) on the display 61. The display 61 is commercially available as Part No. GMF24012EBTW from Stanley Electric Company, Ltd., Equipment Export Section, of Tokyo, Japan.

The touch screen 60 is preferably an X-Y matrix touch screen forming a matrix of touch responsive points. The touch screen 60 includes two closely spaced but normally separated layers of optical grade polyester film each having a set of parallel transparent conductors. The sets of conductors in the two spaced polyester sheets are oriented at right angles to each other so when superimposed they form a grid. Along the outside edge of each polyester layer is a bus which interconnects the conductors supported on that layer. In this manner, electrical signals from the conductors are transmitted to the controller 51. When pressure from a finger or stylus is applied to the upper polyester layer, the set of conductors mounted to the upper layer is deflected downward into contact with the set of conductors mounted to the lower polyester layer. The contact between these sets of conductors acts as a mechanical closure of a switch element to complete an electrical circuit which is detected by the controller 51 through the respective buses at the edges of the two polyester layers, thereby providing a means for detecting the X and Y coordinates of the switch closure. A matrix touch screen 60 of the above type is commercially available from Dynapro Thin Film Products, Inc. of Milwaukee, Wis.

As illustrated in FIG. 6, the touch screen 60 forms a matrix of ninety-six optically transparent switch elements having six columns and sixteen rows. The controller 51 is programmed to divide the switch elements in each column into groups of three to form five switches in each column. Actuation of any one of the three switch elements forming a switch actuates the switch. The uppermost switch element in each column remains on its own and is unused.

Although the touch screen 60 uses an X-Y matrix of optically transparent switches to detect the location of a touch, alternative types of touch screens may be substituted for the touch screen 60. These alternative touch screens use such well-known techniques as crossed beams of infrared light, acoustic surface waves, capacitance sensing, and resistive membranes to detect the location of a touch. The structure and operation of the alternative touch screens are described and illustrated, for example, in U.S. Pat. Nos. 5,317,140, 5,297,030, 5,231,381, 5,198,976, 5,184,115, 5,105,186, 4,931,782, 4,928,094, 4,851,616, 4,811,004, 4,806,709, and 4,782,328, which are incorporated herein by reference.

The mechanical keyboard 57 is primarily used to start (activate) and stop (deactivate) the coin sorter and to enter numerical data. More specifically, the mechanical keyboard 57 includes a START BATCH key, START S/BAT key, VERIFY key, CONTINUE key, STOP key, END key, numeric keypad with numbers 0 through 9, CLEAR key, and ENTER key. After turning on the coin sorter with a main power switch, pressing the BATCH key actuates the drive system 53 and initiates movement of the rotatable disc 13. Coins from a batch of coins may then be fed into the activated coin sorter for sorting. After the coin sorter sorts the coins fed into the coin sorter, the STOP key may be pressed to temporarily stop movement of the rotatable disc 13. If additional unsorted coins remain in the batch, the CONTINUE key is pressed to reactivate the sorter and permit sorting of these additional coins. After the entire batch of coins has been sorted, the END key is pressed following depression of the STOP key to indicate the end of the batch of coins.

While sorting a batch of coins, an operator can also sort a sub-batch of this batch of coins using the START S/BAT key. Prior to pressing the END key to indicate the end of the batch of coins, the operator presses the START S/BAT key to actuate the drive system 53 and activate the coin sorter. The operator then feeds the sub-batch of coins into the coin sorter. After the coin sorter sorts the coins fed into the coin sorter, the STOP key may be pressed to temporarily stop movement of the rotatable disc. If additional unsorted coins remain in the sub-batch, the CONTINUE key is pressed to reactivate the sorter and permit sorting of these additional coins. After the entire sub-batch of coins has been sorted, the END key is pressed following depression of the STOP key to indicate the end of the sub-batch of coins. To indicate the end of the batch, the END key is pressed once again.

Thus, to sort a batch of coins and a sub-batch of coins within that batch of coins, an exemplary key-pressing sequence would be as follows: START BATCH key, STOP key, START S/BAT key, STOP key, END key, and END key. After the STOP key is pressed in the foregoing sequence, additional coins in a batch or sub-batch can be processed through the coin sorter by pressing the CONTINUE key followed by the STOP key.

The sorting and counting of coins can be accomplished without adding to batch, sub-batch, or day totals displayed on the display 61 of the touch screen device 56. This is done by using the VERIFY key, which is active only at the conclusion of a batch of coins. After pressing the END key to indicate the end of a coin batch, the VERIFY key is pressed to activate the coin sorter and permit sorting of coins. The STOP key is then pressed to terminate sorting. The VERIFY key is pressed a second time to exit the "verify" mode and return to the current operating condition of the coin sorter (e.g., "batch ended"). Thus, the key-pressing sequence for sorting and counting coins without adding their value to any batch, sub-batch, or day totals is the following: VERIFY key, STOP key, and VERIFY key. After the STOP key is pressed in the foregoing sequence, additional coins can be processed through the coin sorter by pressing the CONTINUE key followed by the STOP key.

The numeric keypad, the CLEAR key, and the ENTER key are primarily used for entering numerical data on the display 61 of the touch screen device 56. For example, as stated above, whenever one of the counts $C_D$, $C_P$, $C_N$, $C_Q$, $C_S$, and $C_H$ reaches its bag-stop limit, the controller 51 causes the drive system 53 to stop rotation of the disc 13. The automatic bag-stop limit for a particular coin denomination is defined in terms of a numerical quantity. This numerical quantity can be changed by the operator while the controller 51 is in a "programmable bag stop" mode. The operator simply uses the numeric keypad to enter new bag-stop limits for one or more coin denominations. The display 61 displays each number as it is entered. After each new bag-stop limit is entered, the operator presses the ENTER key to store the new bag-stop limit. If the operator makes a mistake while entering a new bag-stop limit, the operator simply presses the CLEAR key and re-enters the bag-stop limit.

The controller 51 is programmed to display various sets of "keys" on the display 61. The "keys" typically include key outlines and legends positioned within the key outlines. If a legend is too lengthy to fit within its associated key outline, the legend is positioned beside the key outline. Each legend designates the function of its associated key. The controller 51 links the functions of the touch screen switches to the keys displayed beneath respective ones of the switches. As a result, pressing the touch screen 60 at a location above a displayed key causes the controller 51 to perform the function associated with that displayed key. Hereinafter, references to pressing a displayed key denote that an operator is pressing the touch screen 60 at a location above the displayed key.

Figure 19A:
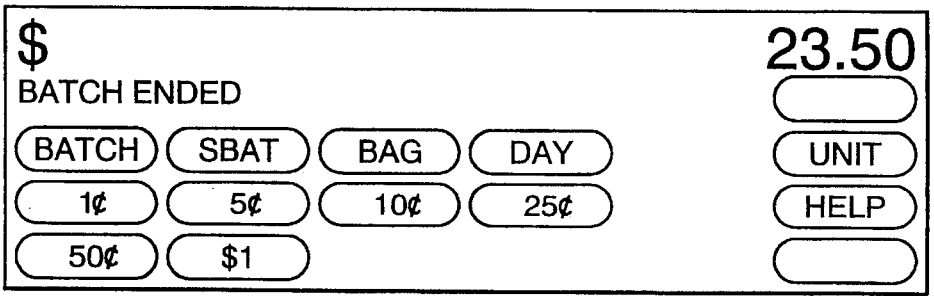
FIGS. 19*a–b* are diagrammatic representations of the touch screen device in FIG. 6 showing a complex display pattern and a simple display pattern.

Using the touch screen 60, an operator can cause the controller 51 to enter various modes, including an operating mode, setup mode, and diagnostic test mode. In the operating mode, the operator can obtain various types of information about coins processed through the coin sorter. The legends of the keys displayed on the display 61 indicate the types of information available for retrieval. To retrieve a certain type of information, the operator simply presses the touch screen 60 at a location above the displayed key which provides that information. The controller 51 indicates that the key has been pressed by illuminating that key. FIG. 19a illustrates a typical display pattern on the display 61 while the controller 51 is in the operating mode. The display pattern includes a BATCH key, SBAT key, BAG key, DAY key, and coin denomination keys. When the coin sorter is processing United States coins, the display pattern typically includes a key for each of the six coin denominations, which include pennies (1*c*), nickels (5*c*), dimes (10*c*), quarters (25*c*), half dollars (50*c*), and dollars ($1).

In response to pressing the BATCH key, the controller 51 causes the display 61 to display in its upper right corner a number denoting the total coin value of a current batch of sorted coins. In response to pressing the SBAT key, the controller 51 causes the display 61 to display in its upper right corner a number denoting the total coin value of a current sub-batch of coins. In response to pressing the BAG key, the controller 51 causes the display 61 to display in its upper right corner a number denoting the total coin value in all bags capturing coins sorted with the coin sorter. In response to pressing the DAY key, the controller 51 causes the display 61 to display in its upper right corner a number denoting the total value of all coins processed through the coin sorter since the last time the "day" totals were cleared. Finally, in response to pressing one of the coin denomination keys while either the BATCH key, SBAT key, BAG key, or DAY key is activated, the controller 51 causes the display 61 to display in it upper right corner a number denoting the total value of sorted coins for the selected denomination. As depicted in FIG. 19*a*, the display pattern typically includes a UNIT key which permits the operator to display in the upper right corner a number representing coin count, as opposed to monetary value, for each of the aforementioned operating mode keys.

In each of its operating modes, the controller 51 preferably provides the operator with on-line help so that the operator need not always rely on instruction manuals and field support for assistance. In particular, the controller 51 causes the display 61 to display a HELP key for each display pattern. In response to pressing the HELP key, the controller 51 causes the display 61 to display a "help" screen having simplified instructions associated with the display pattern. For example, in the operating mode, pressing the HELP key in FIG. 19*a* causes the display 61 to display the following instructions: "select the desired group with the main BATCH, SBAT, etc. keys", "press the denomination keys to see individual coin amounts", and "press the EXIT key to leave this help screen". As indicated by the foregoing instructions, the help screen is provided with an EXIT key to return to the display pattern corresponding to that help screen.

When the controller 51 is in the setup mode, the controller 51 causes the display 61 to initially display the primary display pattern (main setup menu) illustrated in FIGS. 7*a–b*. The primary display pattern provides, for example, the following setup options: ENABLE KEYS, ENABLE FUNCTIONS, DATA ENTRY SELECTIONS, PORT SETUP, PERIPHERAL FORMATS, USER DEFAULTS, BOX/BAG CONFIGURATION, REPOSITION KEYS, KEY LEGENDS, and SCREEN COMPLEXITY. The key legends are located beside their respective keys, as opposed to within their respective keys, because the legends are too lengthy to fit within the keys.

Since the key legends occupy a relatively large portion of the display 61, all of the setup options would not reasonably fit on a single primary display pattern. Therefore, the primary display pattern is divided into two portions which are separately displayed on the display 61 using the MORE and BACK keys. Only one of the two portions is shown on the display 61 at any given time. If FIG. 7*a* represents the portion of the primary display pattern currently on the display 61, the operator presses the MORE key to cause the display 61 to display the portion of the primary display pattern shown in FIG. 7*b*. Similarly, if FIG. 7*b* represents the portion of the primary display pattern currently on the display 61, pressing the BACK key causes the display 61 to display the portion of the primary display pattern shown in FIG. 7*a*. To modify the current settings of a particular setup option in FIGS. 7*a–b*, the operator presses the displayed key of that setup option. Pressing the displayed key causes the controller 51 to display on the display 61 a secondary display pattern (sub-menu). The secondary display pattern includes keys for modifying the current settings of the setup option. The current settings of the setup option are indicated by those keys which are illuminated. To assist the operator in understanding the meaning of the various keys in the secondary display pattern, the secondary display pattern includes a HELP key. When the operator has completed his/her modifications to the current settings of the setup option, the operator returns to the primary display pattern (main setup menu) by pressing an EXIT key.

When the controller 51 is in the diagnostic test mode, the controller 51 causes the display 61 to initially display the primary display pattern (main setup menu) illustrated in FIGS. 8*a–b*. The primary display pattern provides, for example, the following diagnostic test options: MEMORY INFORMATION, ENCODER & COIN SENSORS, KEYBOARD, MOTOR, COIN THRUPUT, COIN STOP, BRAKE CYCLE, REMOTE DISPLAY, and MACHINE STATISTICS. The key legends are located beside their respective keys, as opposed to within their respective keys, because the legends are too lengthy to fit within the keys.

Since the key legends occupy a relatively large portion of the display 61, all of the diagnostic test options would not reasonably fit on a single primary display pattern. Therefore, the primary display pattern is divided into two portions which are separately displayed on the display 61 using the MORE and BACK keys. Only one of the two portions is shown on the display 61 at any given time. If FIG. 8*a* represents the portion of the primary display pattern currently on the display 61, the operator presses the MORE key to cause the display 61 to display the portion of the primary display pattern shown in FIG. 8*b*. Similarly, if FIG. 8*b* represents the portion of the primary display pattern currently on the display 61, pressing the BACK key causes the display 61 to display the portion of the primary display pattern shown in FIG. 8*a*. To select a particular diagnostic test option in FIGS. 8*a–b*, the operator presses the displayed key of that diagnostic test option.

Depending upon the selected diagnostic test, the controller 51 either automatically performs the selected diagnostic test or prompts the operator to enter numerical data (using the numeric keypad) prior to performing the diagnostic test. For example, in response to pressing the displayed key for the KEYBOARD diagnostic test option, the controller 51 causes the display 61 to display a 6×5 matrix of keys without legends. To check whether or not the touch screen 60 is operating correctly, the operator is prompted to press any of the keys on the 6×5 matrix. If the touch screen 60 is working properly, the pressed key should be illuminated while it is touched by the operator. The prompts for data entry and the results of the selected diagnostic test are displayed on the display 61 as secondary display patterns. To assist the operator in performing the diagnostic tests, the secondary display pattern(s) associated with each diagnostic test include a HELP key. When the operator has completed a diagnostic test, the operator returns to the primary display pattern (main setup menu) by pressing an EXIT key.

The setup and diagnostic test modes illustrate the flexibility, versatility, and user friendliness of the touch screen device 56. In particular, the use of lengthy external key legends facilitates comprehension of the function of a particular key. If these external key legends were substituted with abbreviated legends located within their respective keys, the operator may need to consult an instruction manual to understand the function of the keys. The external key legends often obviate the need to consult instruction manuals. Furthermore, although the lengthy external key legends reduce the number of keys which can be displayed at a given time on the display 61, a relatively large number of keys with external key legends can easily be divided into two or more groups and each group can be separately displayed on the display 61 (see, e.g., FIGS. 7*a–b* and 8*a–b*). In response to pressing a MORE key or a BACK key, the controller 51 controls which group of keys is displayed on the display 61.

In conjunction with the touch screen device 56, the controller 51 can create a hierarchy of display patterns for display on the display 61. The display pattern may include display fields with textual information, numerical information, data entry prompts, or keys actuated via the touch screen 60. The touch screen device 56 and controller 51 permit a virtually unlimited number of keys to be displayed on the display 61, the number of keys being constrained primarily by the capacity of memory in the controller 51. Movement from one display pattern to the next is achieved by pressing a key, such as a MORE key or a BACK key, displayed on the current display pattern. Such a large number of keys would occupy an inordinate amount of space if formed as part of the mechanical keyboard 57.

The touch screen device 56 provides the operator with several advantageous features which are described in connection with FIGS. 9–19. One advantageous feature is that the operator can use the touch screen device 56 to label the data entry fields A, B, C, and D with textual information, in addition to or instead of the labels A, B, C, and D, indicating the source of a sorted coin batch. These textual labels are typically more meaningful to the operator than the labels A, B, C, and D and may be incorporated in a printed report for a sorted batch of coins. To provide a data entry field with a textual label, the operator enters the setup mode and presses the key labelled DATA ENTRY SELECTIONS. In response to pressing this key, the controller 51 causes the display 61 to display the following three data entry options: SELECT LABELS, SELECT RECEIPTS, and SELECT OTHER. The operator presses the key associated with SELECT LABELS, which causes the display 61 to display the four data entry fields A, B, C, and D. Each data entry field is accompanied by a CUSTOM key.

Figure 9:
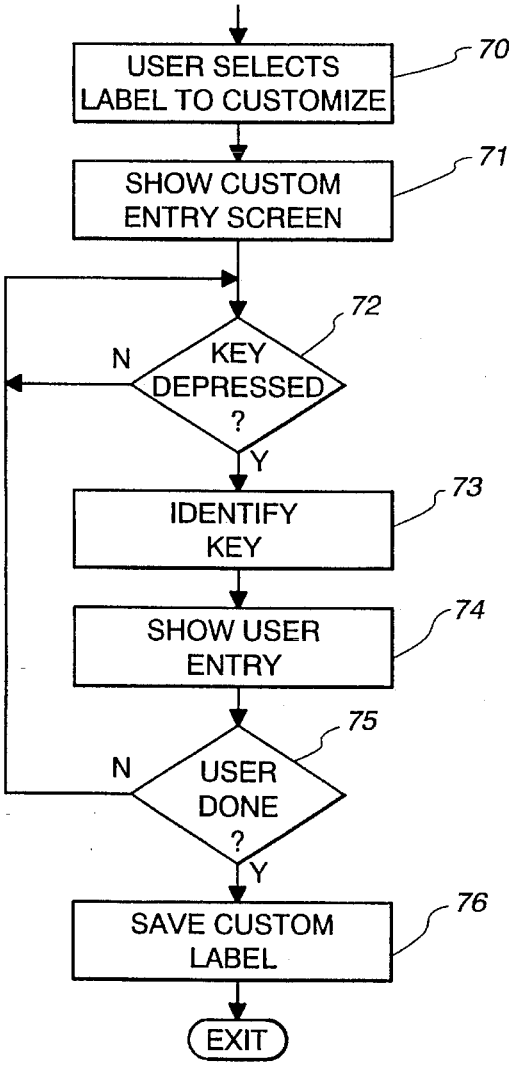
FIG. 9 is a flow diagram showing the operation of providing data entry fields with custom labels, using a setup mode of the controller in FIG. 5.

Referring to the flow diagram in FIG. 9, the operator selects a data entry field to customize by pressing the CUSTOM key accompanying the selected data entry field (step 70). In response to pressing the CUSTOM key, the controller 51 causes the display 61 to display a custom entry display pattern including keys for the letters of the alphabet (step 71). The operator then enters a custom label not to exceed a predetermined number of letters and/or numbers (steps 72–75). The operator selects letters using the displayed letter keys and selects numbers using the numeric keypad of the mechanical keyboard 57. The controller 51 determines whether a displayed letter key or a mechanical number key is pressed at step 72. If a key is pressed, the controller 51 identifies the pressed key at step 73 and displays the letter or number associated with the pressed key at step 74. When the operator has completed entry of the custom label, the operator presses the ENTER key on the mechanical keyboard 57 (step 75). Pressing the ENTER key causes the controller 51 to save the custom label (step 76). To return to the main setup menu, the operator presses an EXIT key on the display 61 until the main setup menu is displayed.

Figure 10A:
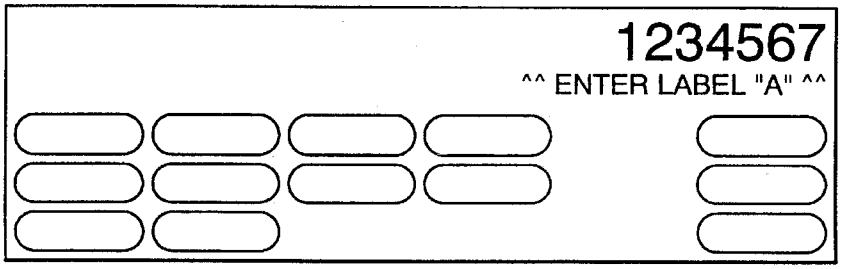
FIGS. 10*a–b* are diagrammatic representations of the touch screen device in FIG. 6 showing display patterns with and without a custom label.
Figure 10B:
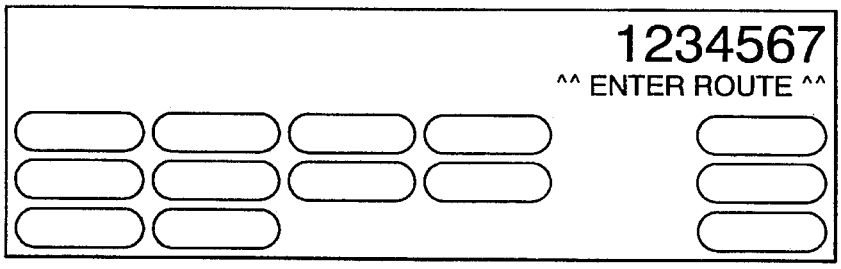

FIGS. 10*a–b* illustrate exemplary display patterns (without key legends) before the data entry field A is provided with a custom label (FIG. 10*a*) and after the field A is provided with a custom label (FIG. 10*b*). Before the field A is labelled with textual information, the field A merely includes a numeric code 1234567 accompanied by the information "label 'A'" (FIG. 10*a*). After customizing the label for field A, the information "LABEL 'A'" is replaced with more meaningful information such as "ROUTE" (FIG. 10*b*). With the customized label, the operator knows that the numeric code 1234567 represents a route (e.g., driver number). Thus, the custom label in FIG. 10*b* provides the operator with meaningful information regarding the source of a coin batch.

In a manner similar to customizing data entry fields, the operator can use the touch screen device 56 to modify (edit) key legends. To modify a key legend, the operator simply enters the setup mode and presses the key labelled KEY LEGENDS. After selecting the key legend to be modified, the controller 51 causes the display 61 to display a custom entry display pattern including keys for the letters of the alphabet. To edit the key legend, the operator selects letters using the displayed letter keys and selects numbers using the numeric keypad of the mechanical keyboard 57. While modifying the key legend, the operator should remember that the function of the key associated with that legend does not change by editing the legend. In other words, the function of the key remains the same regardless of the legend entered for that key. In connection with FIG. 9, the procedure for editing key legends is substantially the same as the procedure for customizing field labels, except that at step 70 the operator selects the key legend to edit and at step 76 the operator saves the edited key legend.

Figure 11A:
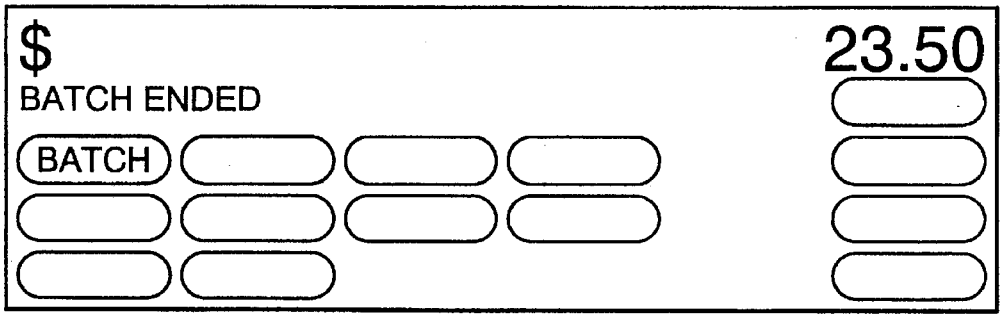
FIGS. 11*a–b* are diagrammatic representations of the touch screen device in FIG. 6 showing a displayed key with and without a custom key legend.
Figure 11B:
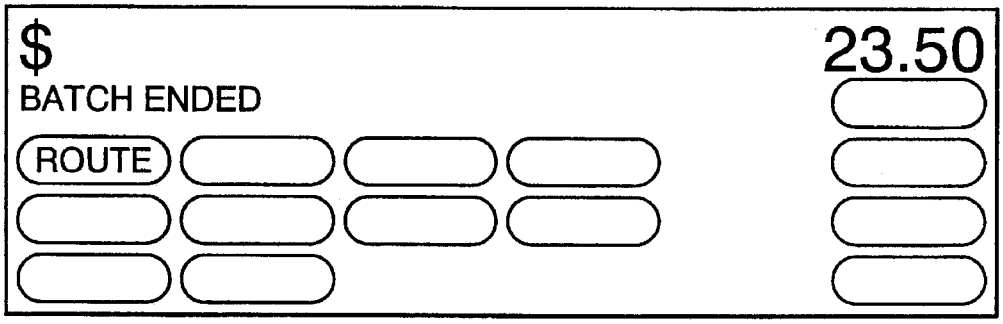

FIGS. 11*a–b* illustrate exemplary display patterns before the key legend for the BATCH key is modified (FIG. 11*a*) and after key legend for the BATCH key is modified (FIG. 11*b*). Before the key legend is modified, the BATCH key includes the legend "BATCH" within the key outline. After modifying the key legend, the BATCH key includes the legend "ROUTE" within the key outline. The key legend "ROUTE" would indicate to the operator that the sorted batch of coins having a value of $23.50 pertain to a "route", as opposed to some other type of coin batch. Thus, like data entry fields with custom labels, the edited key legend provides the operator with meaningful information regarding the type of coin batch.

Another advantageous feature of the much screen device 56 is that the operator can use the touch screen device 56 to delete (disable) or add (enable) keys displayed on the display 61. For example, an operator (e.g., a vending company) having no use for a particular coin denomination such as pennies can delete all references by the display 61 to that coin denomination. To delete or add a key for display on the display 61, the operator enters the setup mode and presses the key labelled ENABLE KEYS.

Figure 12:
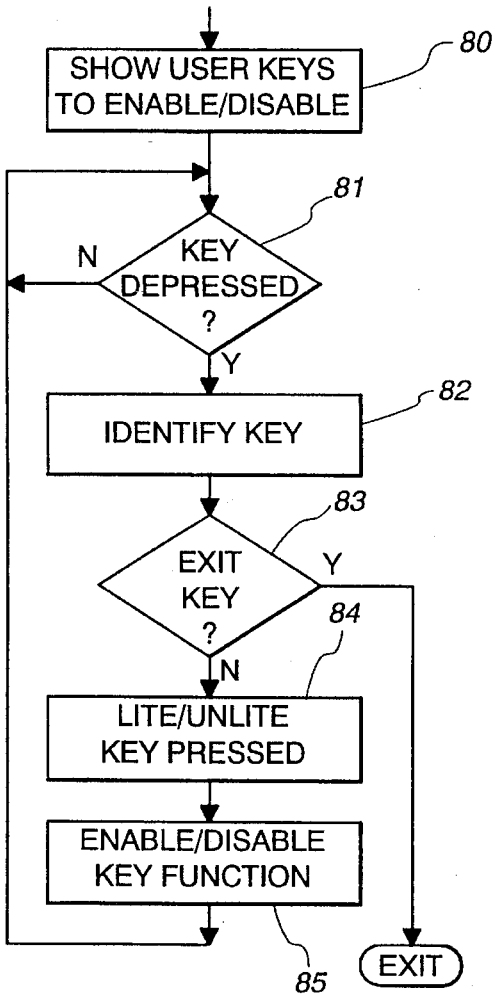
FIG. 12 is a flow diagram showing the operation of enabling and disabling keys, using the setup mode of the controller in FIG. 5.

Referring to the flow diagram in FIG. 12, in response to pressing this key, the controller 51 causes the display 61 to display those keys which may be enabled or disabled (step 80). The current settings of the keys are determined by whether or not they are illuminated. The illuminated keys are enabled while the non-illuminated keys are disabled. After showing the operator the keys which may be enabled or disabled (step 80), the controller 51 determines whether a displayed key is pressed at step 81. If a key is pressed, the controller 51 identifies the pressed key at step 82. If the identified key is not the exit key (step 83), the controller 51 disables the pressed key if it was previously enabled and the controller 51 enables the pressed key if it was previously disabled (steps 84 and 85). If at step 83 the controller 51 identifies the pressed key to be the exit key, the controller 51 exits the ENABLE KEYS setup option and returns to the main setup menu.

Figure 13A:
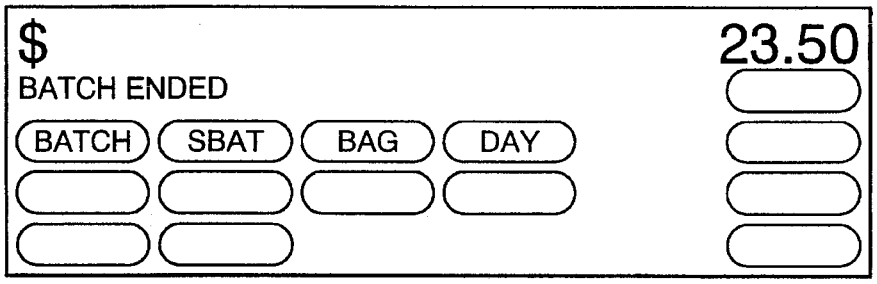
FIGS. 13*a–b* are diagrammatic representations of the touch screen device in FIG. 6 showing display patterns with and without an SBAT key.
Figure 13B:
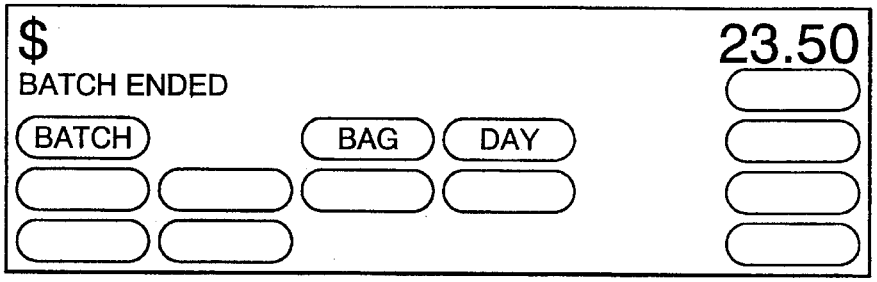

In the operating mode of the controller 51, the controller 51 does not display the disabled keys on the display 61. If, for example, the operator disabled the SBAT key because the operator does not sort sub-batches of coins, the controller 51 does not display the SBAT key. FIGS. 13*a–b* illustrate exemplary display patterns in the operating mode of the controller 51 before the SBAT key is deleted (FIG. 13*a*) and after the SBAT key is deleted (FIG. 13*b*).

Figure 15A:
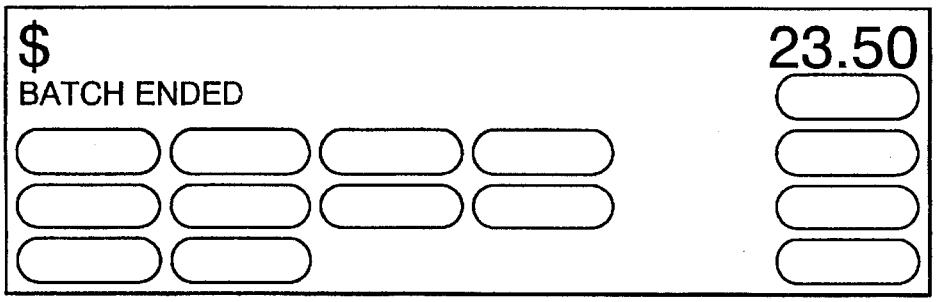
FIGS. 15*a–b* are diagrammatic representations of the touch screen device in FIG. 6 showing display patterns with and without a PRINT key.
Figure 14:
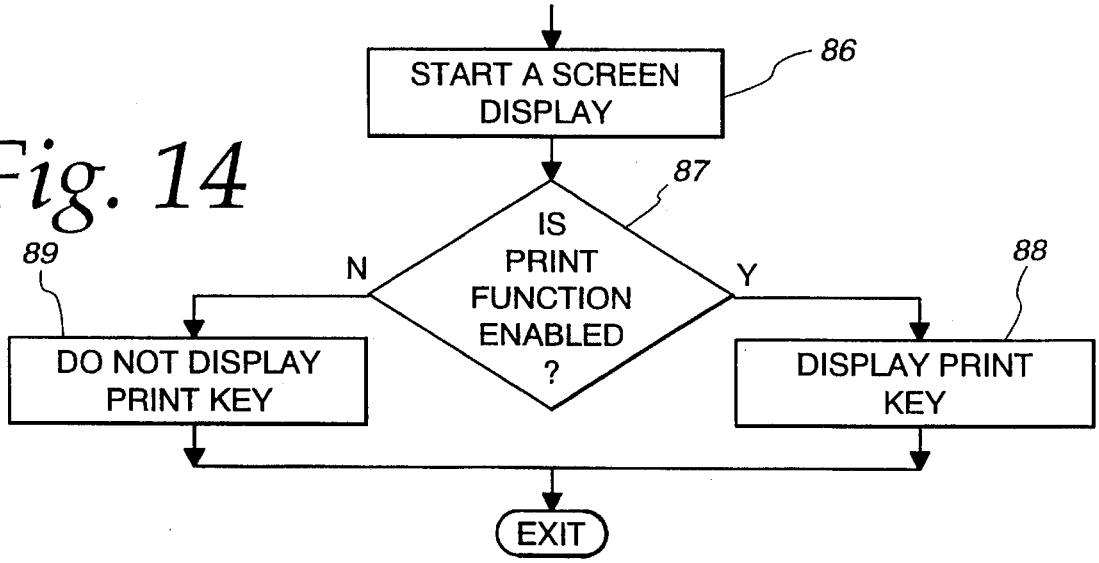
FIG. 14 is a flow diagram showing the operation of enabling and disabling a print key by enabling and disabling the print function, using the setup mode of the controller in FIG. 5.
Figure 15B:
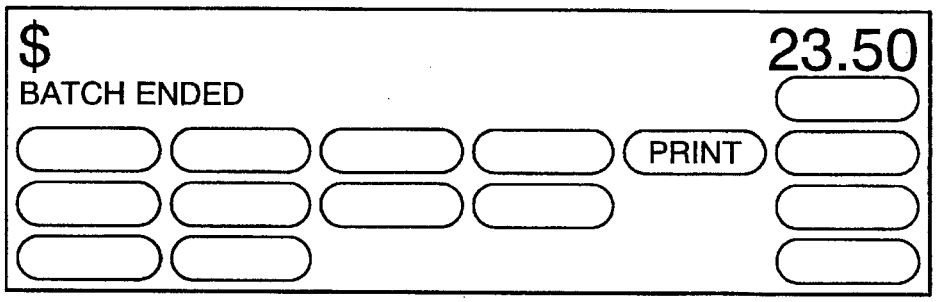

The operator also has the ability to add or delete keys displayed on the display 61 by enabling or disabling the function associated with the keys. This feature is illustrated in FIGS. 14 and 15*a–b* in connection with the print key. More specifically, to add the print key to the display pattern in FIG. 15*a*, the operator enters the setup mode and presses the key labelled ENABLE FUNCTIONS.

Referring to the flow diagram in FIG. 14, in response to pressing this key, the controller 51 causes the display 61 to display those functions which may be enabled or disabled (step 86). The status of a particular function is indicated by one or more keys located adjacent a textual description of the function. With respect to the print key, the display 61 displays, for example, the word "printer" followed by an OFF key and an ON key. The status of the print key is indicated by which of the two keys is illuminated. If the OFF key is illuminated, the controller 51 does not display the print key in its operating mode (steps 87 and 89). FIG. 15*a* illustrates an exemplary display pattern with the print key disabled. If the ON key is illuminated, the controller 51 displays the print key in its operating mode (steps 87 and 88). FIG. 15*b* illustrates an exemplary display pattern with the print key enabled. The operator may change the status of the print key simply by pressing the OFF key when the ON key is illuminated or by pressing the ON key when the OFF key is illuminated. To return to the main setup menu, the operator presses an EXIT key.

In a manner similar to disabling and enabling keys, the touch screen device 56 may be used to reposition keys displayed on the display 61 in accordance with the preferences of the operator. For example, an operator which repeatedly uses the BATCH key may wish to position the key on the display 61 at a location which facilitates his/her operation of that key. To reposition a key displayed on the display 61, the operator enters the setup mode and presses the key labelled REPOSITION KEYS. In response to pressing this key, the controller 51 causes the display 61 to display those keys which may be repositioned.

Referring to the flow diagram in FIG. 16, after showing the operator the keys which may be repositioned, the operator first presses a displayed key ("first key") which he/she would like to reposition. The controller 51 determines whether the first key is pressed at step 90. If the first key is pressed, the controller 51 identifies and illuminates the pressed first key (steps 91 and 92). Next, the operator presses a second key located where the operator would like to reposition the first key. The controller 51 determines whether this second key is pressed at step 93. In order to reposition the first key to the location of the second key, the location of the second key must be unused. That is, another function must not already accompany this second key. The controller 51 determines whether the second key is used at step 94. If the second key is unused, the controller 51 repositions the first key to the location of this second key (step 95) and defines the function of this second key to correspond to that of the first key (step 96). If at step 94 the location of the second key is already used, the controller 51 unlights the first key (step 97) and illuminates the second key (step 92). The controller 51 has, in essence, determined that the operator intended to reposition the second key, not the first key, so that the controller 51 waits for the operator to press a third key located where the operator would like to reposition the second key (step 93). As long as this third key is unused (step 94), the controller 51 will move the second key to the location of the third key (step 95) and define the function of the third key to correspond to that of the second key (step 96). The operator returns to the main setup menu by pressing an EXIT key on the display 61.

In an alternative embodiment, if the operator attempts to reposition a first key to a used second key location, the controller 51 interchanges the first and second keys and their associated functions.

In the operating mode of the controller 51, the controller 51 displays the keys on the display 61 in accordance with any new positions assigned to the keys in the setup mode. FIGS. 17*a–b* illustrate exemplary display patterns in the operating mode of the controller 51 before the BATCH key and BAG key are repositioned (FIG. 17*a*) and after these two keys are repositioned (FIG. 17*b*). It should be understood that the controller 1 redefines a lookup table in memory so that the function of a key remains with the key when it is repositioned. In particular, when the key is repositioned from a first location to a second location, the controller 51 redefines the lookup table so that the switch above the second location is now operably connected to the function of the repositioned key and the switch above the first location is no longer operably connected to the function of the repositioned key.

Yet another advantageous feature of the touch screen device 56 is that the operator can modify the complexity of the display pattern on the display 61 to match the level of experience of the operator. For example, a novice may prefer a large number of relatively simple display patterns while a more experienced operator may prefer a small number of relatively complex display patterns.

Figure 18:
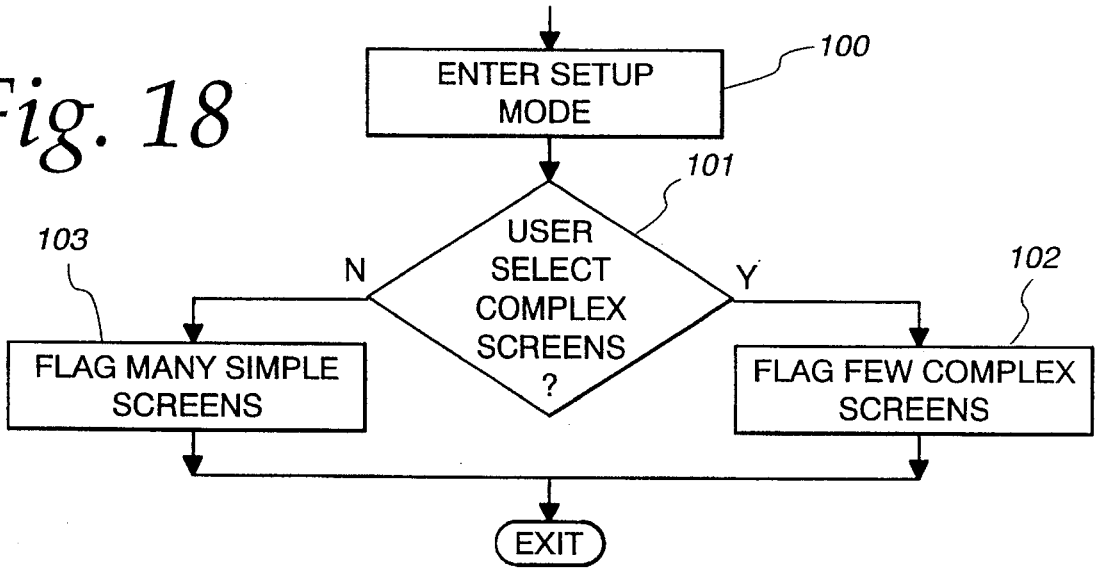
FIG. 18 is a flow diagram showing the operation of selecting the complexity of the display pattern displayed on the touch screen device in FIG. 6, using the setup mode of the controller in FIG. 5.

Referring to the flow diagram in FIG. 18, to modify the complexity of the display pattern displayed on the display 61, the operator enters the setup mode and presses the key labelled SCREEN COMPLEXITY (step 100). In response to pressing this key, the controller 51 gives the operator the option of selecting complex display patterns (step 101). If the operator selects complex display patterns, the controller 51 will provide a relatively small number of complex display patterns in its operating mode (step 102). If the operator does not select complex display patterns, the controller 51 will provide a relatively large number of simple display patterns in its operating mode (step 103). To return to the main setup menu, the operator presses an EXIT key on the display 61.

Figure 19B:
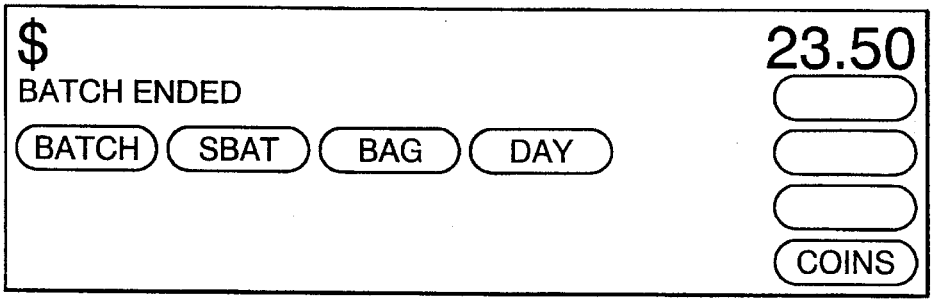

In the operating mode of the controller 51, the complexity of the display patterns on the display 61 corresponds to the selection made by the operator in the SCREEN COMPLEXITY setup option. FIGS. 19*a–b* illustrate exemplary complex and simple display patterns. Both display patterns include the BATCH key, SBAT key, BAG key, and DAY key. Only the complex display pattern (FIG. 19*a*), however, includes the coin denomination keys for pennies, nickels, dimes, quarters, half dollars, and dollars. If the operator selects simple display patterns in the setup mode, these coin denomination keys are provided on a secondary display pattern in the operating mode of the controller 51. The controller 51 displays these coin denomination keys on the display 61 in response to pressing the COINS key in FIG. 19*b*.

While the present invention has been described with reference to one or more particular embodiments, those skilled in the art will recognize that many changes may be made thereto without departing from the spirit and scope of the present invention.

For example, the coin sorting system may employ other types of coin sorters other than the disc-type sorter illustrated in FIGS. 3 and 4, including a disc-to-disc type coin sorter, a rail-type coin sorter with exit channels, and a modified rail-type coin sorter with exit apertures. Each of these types of coin sorters uses a coin-driving member having a resilient surface for moving coins along a metal coin-guiding surface of a stationary coin-guiding member. In the disc-to-disc type coin sorter, the coin-driving members include a pair of rotating discs and the coin-guiding members include a stationary queuing head and a stationary sorting disc. The disc-to-disc type coin sorter is described in further detail in U.S. application Ser. No. 08/178,658 entitled "Coin Queuing and Sorting Arrangement", filed Jan. 7, 1994, now U.S. Pat. No. 5,425,669 and incorporated herein by reference. In the rail-type coin sorter, the coin-driving member is a drive belt and the coin-guiding member is a stationary sorting rail. The sorting rail either includes exit channels or apertures. The rail-type coin sorter is described in further detail in U.S. application Ser. No. 08/037,269 entitled "Coin Queuing Device and Power Rail Sorter", filed Mar. 26, 1993, now U.S. Pat. No. 5,382,191 and incorporated herein by reference.

Each of these embodiments and obvious variations thereof is contemplated as falling within the spirit and scope of the claimed invention, which is set forth in the following claims.

What is claimed is:

1. A coin sorting system, comprising:

a coin sorter for sorting a plurality of coins of mixed denominations, the coin sorter including a coin-driving member having a resilient surface and a stationary coin-guiding member having a coin-guiding surface opposing the resilient surface of the coin-driving member, the coin-guiding surface being positioned generally parallel to the resilient surface, the resilient surface of the coin-driving member constructed and arranged to move the coins along the coin-guiding surface of the coin-guiding member, the coin-guiding surface forming a plurality of exit stations for selectively allowing exiting of the coins based upon their respective diameters;

coin sensors constructed and arranged to detect the coins being sorted;

a control unit, coupled to the coin sensors, for counting the coins detected by the coin sensors so as to generate coin data; and an operator interface panel coupled to the control unit and including a display unit and a touch screen mounted over the display unit, the control unit causing the display unit to display keys associated with the coin data, the control unit operably coupling the touch screen to the displayed keys such that actuation of the touch screen at a position above one of the displayed keys causes the control unit to generate on the display unit the coin data associated with the one of the displayed keys.

2. The coin sorting system of claim 1, wherein the display unit includes a display field for displaying coin sorter status, and the control unit is configured to display the coin sorter status in the display field for displaying coin sorter status.

3. The coin sorting system of claim 1, wherein the coin sensors are constructed and arranged to permit the control unit to separately count the coins of each denomination.

4. The coin sorting system of claim 3, wherein the coin sensors are mounted in the exit stations formed by the coin-guiding surface of the coin sorter.

5. The coin sorting system of claim 1, wherein the coin data associated with the displayed keys is selected from the group consisting of (1) a coin total of the plurality of coins sorted with the coin sorter and (2) a coin total of the coins of each denomination.

6. The coin sorting system of claim 1, wherein the control unit represents the coin data on the display unit in terms of monetary value.

7. The coin sorting system of claim 1, wherein the control unit represents the coin data on the display unit in terms of unit counts.

8. The coin sorting system of claim 1, wherein the control unit is operable, via the touch screen, in a plurality of modes including a diagnostic mode, a setup mode, and an operating mode, the control unit causing the display unit to display keys associated with a selected one of the modes.

9. A method for operating a coin sorting system including a coin sorter, coin sensors mounted in proximity to the coin sorter, and a control unit coupled to the coin sensors, the operator interface panel being coupled to the control unit and including a display unit and a touch screen mounted over the display unit, the method comprising the steps of:

sorting a plurality of coins of mixed denominations with the coin sorter;

detecting the coins being sorted using the coin sensors;

counting the coins detected by the coin sensors using the control unit so as to generate coin dam;

displaying, under control of the control unit, on the display unit keys associated with the coin data, the control unit operably coupling the touch screen to the displayed keys;

actuating the touch screen at a position above one of the displayed keys; and displaying, under control of the control unit, on the display unit the coin data associated with the one of the displayed keys.

10. The method of claim 9, further including the step of displaying, under control of the control unit, on the display unit coin sorter status.

11. The method of claim 9, wherein the step of counting the coins detected by the coin sensors includes separately counting the coins of each denomination.

12. The method of claim 9, wherein the coin data associated with the displayed keys is selected from the group consisting of (1) a coin total of the plurality of coins sorted with the coin sorter and (2) a coin total of the coins of each denomination.

13. The method of claim 9, wherein the step of displaying on the display unit the coin data includes displaying the coin data in terms of monetary value.

14. The method of claim 9, wherein the step of displaying on the display unit the coin data includes displaying the coin data in terms of unit counts.

15. A method for operating a coin sorting system in a setup mode and an operating mode, the coin sorting system including a coin sorter for sorting a plurality of coins, coin sensors mounted in proximity to the coin sorter for detecting the coins being sorted, and a control unit coupled to the coin sensors for counting the coins detected by the coin sensors so as to generate coin data, the operator interface panel being coupled to the control unit and including a display unit and a touch screen mounted over the display unit, the control unit operably coupling the touch screen to the display unit, the control unit causing the display unit to display the coin data and a label indicating a source for the coin data while the coin sorting system is in the operating mode, the method comprising the steps of:

entering the setup mode via the operator interface panel, the control unit causing the display unit to display a setup option for customizing labels after entering the setup mode;

selecting, via the touch screen, the setup option for customizing labels, the control unit causing the display unit to display a plurality of keys for generating custom labels after selecting the setup option for customizing labels;

entering, via the touch screen, a custom label by actuating the touch screen at positions above one or more of the keys for generating custom labels, the control unit displaying the custom label on the display unit during the operating mode; and exiting, via the touch screen, the setup option for customizing labels.

16. A method for operating a coin sorting system in a setup mode and an operating mode, the coin sorting system including a coin sorter for sorting a plurality of coins, coin sensors mounted in proximity to the coin sorter for detecting the coins being sorted, and a control unit coupled to the coin sensors for counting the coins detected by the coin sensors so as to generate coin data, the operator interface panel being coupled to the control unit and including a display unit and a touch screen mounted over the display unit, the control unit causing the display unit to display keys having customizable key legends while the coin sorting system is in the operating mode, the control unit operably coupling the touch screen to the displayed keys, the method comprising the steps of:

entering the setup mode via the operator interface panel, the control unit causing the display unit to display a setup option for customizing key legends after entering the setup mode;

selecting, via the touch screen, the setup option for customizing key legends, the control unit causing the display unit to display the keys having customizable key legends after selecting the setup option for customizing key legends;

selecting, via the touch screen, one of the keys having customizable key legends, the control unit causing the display unit to display a plurality of keys for generating custom key legends after selecting one of the keys having customizable key legends;

entering, via the touch screen, a custom key legend by actuating the touch screen at positions above one or more of the keys for generating custom key legends, the control unit displaying the selected one of the keys with the custom key legend on the display unit during the operating mode; and exiting, via the touch screen, the setup option for customizing key legends.

17. A method for operating a coin sorting system in a setup mode and an operating mode, the coin sorting system including a coin sorter for sorting a plurality of coins, coin sensors mounted in proximity to the coin sorter for detecting the coins being sorted, and a control unit coupled to the coin sensors for counting the coins detected by the coin sensors so as to generate coin data, the operator interface panel being coupled to the control unit and including a display unit and a touch screen mounted over the display unit, the control unit operably coupling the touch screen to the display unit, the method comprising the steps of:

entering the setup mode via the operator interface panel, the control unit causing the display unit to display a setup option for enabling and disabling keys after entering the setup mode;

selecting, via the touch screen, the setup option for enabling and disabling keys, the control unit causing the display unit to display a plurality of keys after selecting the setup option for enabling and disabling keys;

designating, via the touch screen, an enable/disable status for a specific key of the plurality of keys, the control unit displaying the specific key on the display unit during the operating mode in response to enabling the specific key during the setup mode, the control unit not displaying the specific key on the display unit during the operating mode in response to disabling specific key during the setup mode; and exiting, via the touch screen, the setup option for enabling and disabling keys.

18. A method for operating a coin sorting system in a setup mode and an operating mode, the coin sorting system including a coin sorter for sorting a plurality of coins, coin sensors mounted in proximity to the coin sorter for detecting the coins being sorted, and a control unit coupled to the coin sensors for counting the coins detected by the coin sensors so as to generate coin dam, the operator interface panel being coupled to the control unit and including a display unit and a touch screen mounted over the display unit, the control unit operably coupling the touch screen to the display unit, the method comprising the steps of:

entering the setup mode via the operator interface panel, the control unit causing the display unit to display a setup option for enabling and disabling control unit functions after entering the setup mode;

selecting, via the touch screen, the setup option for enabling and disabling control unit functions, the control unit causing the display unit to display a plurality of control unit functions after selecting the setup option for enabling and disabling control unit functions;

designating, via the touch screen, an enable/disable status for a specific function of the plurality of control unit functions, the control unit displaying a key associated with the specific function on the display unit during the operating mode in response to enabling the specific function during the setup mode, the control unit not displaying the key associated with the specific function on the display unit during the operating mode in response to disabling the specific function during the setup mode; and exiting, via the touch screen, the setup option for enabling and disabling control unit functions.

19. A method for operating a coin sorting system in a setup mode and an operating mode, the coin sorting system including a coin sorter for sorting a plurality of coins, coin sensors mounted in proximity to the coin sorter for detecting the coins being sorted, and a control unit coupled to the coin sensors for counting the coins detected by the coin sensors so as to generate coin data, the operator interface panel being coupled to the control unit and including a display unit and a touch screen mounted over the display unit, the control unit causing the display unit to display keys while the coin sorting system is in the operating mode, the control unit operably coupling the touch screen to the displayed keys, the method comprising the steps of:

entering the setup mode via the operator interface panel, the control unit causing the display unit to display a setup option for repositioning keys after entering the setup mode;

selecting, via the touch screen, the setup option for repositioning keys, the control unit causing the display unit to display the keys after selecting the setup option for repositioning keys;

repositioning, via the touch screen, a specific one of the keys from a first position to a second position on the display unit by actuating the touch screen at locations above the first and second positions, the control unit displaying the specific one of the keys on the display unit at the second position during the operating mode; and exiting, via the touch screen, the setup option for repositioning keys.

20. A method for operating a coin sorting system in a setup mode and an operating mode, the coin sorting system including a coin sorter for sorting a plurality of coins, coin sensors mounted in proximity to the coin sorter for detecting the coins being sorted, and a control unit coupled to the coin sensors for counting the coins detected by the coin sensors so as to generate coin data, the operator interface panel being coupled to the control unit and including a display unit and a touch screen mounted over the display unit, the control unit causing the display unit to display arrays of keys while the coin sorting system is in the operating mode, the control unit operably coupling the touch screen to the displayed keys, the method comprising the steps of:

entering the setup mode via the operator interface panel, the control unit causing the display unit to display a setup option for key array complexity after entering the setup mode;

selecting, via the touch screen, the setup option for key array complexity, the control unit causing the display unit to display array complexity options for relatively complex key arrays and relatively simple keys arrays after selecting the setup option for key array complexity;

selecting, via the touch screen, one of the array complexity options, the control unit displaying on the display unit key arrays with a relatively large number of keys during the operating mode in response to selecting the option for relatively complex key arrays during the setup mode, the control unit displaying on the display unit key arrays with a relatively small number of keys during the operating mode in response to selecting the option for relatively simple key arrays during the setup mode; and exiting, via the touch screen, the setup option for screen complexity.

* * * * *